United States Patent [19]

Kirkpatrick

[11] 4,005,633

[45] Feb. 1, 1977

[54] STRUCTURE FOR ARTICLE HANDLING SYSTEMS

[75] Inventor: Robert G. Kirkpatrick, Shelburne, Vt.

[73] Assignee: General Electric Company, Burlington, Vt.

[22] Filed: Mar. 21, 1975

[21] Appl. No.: 560,346

Related U.S. Application Data

[63] Continuation of Ser. No. 414,205, Nov. 9, 1973, abandoned.

[52] U.S. Cl. ..... 89/33 D

[51] Int. Cl.[2] ..... F41D 9/06

[58] Field of Search ..... 89/33 D; 42/50, 87

[56] References Cited

UNITED STATES PATENTS

| | | | |
|---|---|---|---|
| 1,329,979 | 2/1920 | Lang | 89/33 D |
| 1,330,873 | 2/1920 | Hulse | 89/33 D |
| 2,887,811 | 5/1959 | Johnson | 42/87 |

*Primary Examiner*—Stephen C. Bentley
*Attorney, Agent, or Firm*—Bailin L. Kuch

[57] ABSTRACT

A drum ammunition system has drum partition which ensure a rotation of the case about its own longitudinal axis within the drum partitions as the case is advanced parallel to the drum longitudinal axis along the drum partitions by the helix.

10 Claims, 4 Drawing Figures

D
18
32
36
12

44
30
26
B
18
46
48
24
C
16
28
22
20
A

STRUCTURE FOR ARTICLE HANDLING SYSTEMS

The invention herein described was made in the course of or under a contract or subcontract thereunder with the Department of the Air Force.

RELATED CASE

This application is a continuation of Ser. No. 414,205, filed Nov. 9, 1973, now abandoned.

BACKGROUND OF THE INVENTION

1. Field of the Invention

This invention relates to the construction of article guides for article handling systems, particularly the longitudinally extending drum partitions of linkless, drum type ammunition storage systems.

2. Prior Art

Linkless, drum type ammunition storage systems are well known, and are shown, for example, in U.S. Pat. No. 3,696,704 issued to L. F. Backus et al on Oct. 12, 1972, and the many other patents and publications cited therein, herein incorporated by reference. Conventionally, such systems comprise a central helix or auger rotating about a central, longitudinal axis within an outer drum having a plurality of centripetally directed, longitudinally extending guides or partitions disposed in an annular row about the central axis. Rounds of ammunition are stored in longitudinally extending columns with their bases respectively interlocked between adjacent partitions, and their tips respectively disposed between adjacent turns of the helix. As the helix rotates, it advances the rounds longitudinally. In a single ended system, only rounds are stored. In a double ended or closed loop system, fired cases are also returned and stored.

Generally, the center of gravity of an unfired round is well within the transverse area of the helix, and the round remains perpendicular to the longitudinal axis of the drum as the helix engages it between its center of gravity and its extractor disk and pushes it along between the drum partitions. In contradistinction, the center of gravity of a fired case is entirely outside the transverse area of the helix. The helix engages the case at the same point as with an unfired round, which point is not between its empty center of gravity and its extractor disk. When unloading the drum of fired, empty cases, the longitudinal movement of the empty cases leaves the last layer of empty cases unsupported by succeeding cases as the rear of the drum becomes progressively void of empty cases. The non-intermediate load applied by the helix causes this last layer to tilt within the clearance of adjacent turns of the helix. If there is a high frictional force between the extractor disk of the fired case and the drum partitions, the tilt tends to wedge the extractor disk between the drum partitions until it deflects the adjacent layer of the helix enough to permit enough tilt to cause a jam of the extractor disk between the drum partitions.

Accordingly, it is an object of this invention to provide a system which minimizes the frictional force developed between the extractor disk of a case and the drum partitions.

A feature of this invention is the provision of a system having drum partitions which ensure a rotation of the case about its own longitudinal axis within the drum partitions as the case is advanced parallel to the drum longitudinal axis along the drum partitions by the helix.

BRIEF DESCRIPTION OF THE DRAWING

These and other objects, features and advantages of this invention will be apparent from the following specification thereof taken in conjunction with the accompanying drawing in which.

DESCRIPTION OF THE PREFERRED EMBODIMENT

Figure 2:
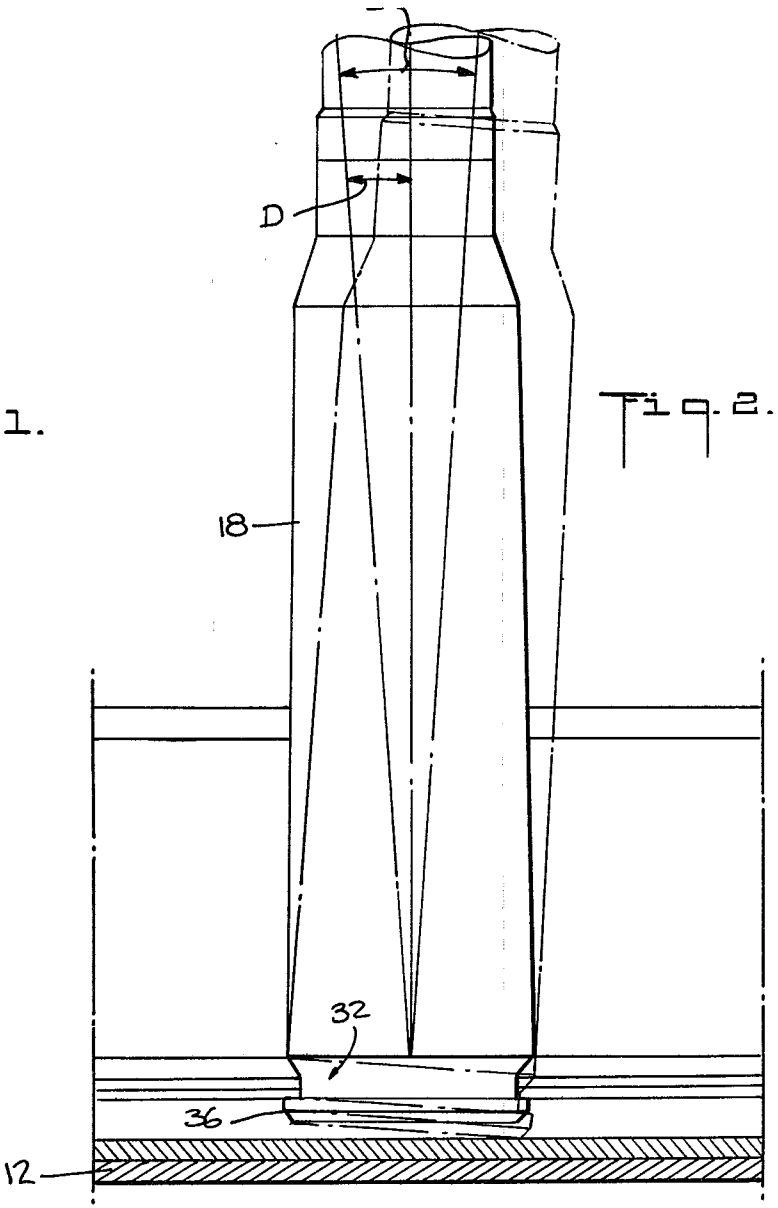
FIG. 2 is a partial view in longitudinal cross-section of a drum of the system of FIG. 1.

The linkless, drum type ammunition handling system may be of the type shown generally by L. F. Bakus et al in U.S. Pat. No. 3,696,704 issued Oct. 10, 1972. It may advantageously incorporate the helix shown by J. Dix et al in U.S. patent application Ser. No. 352,007 filed Apr. 17, 1973.

The conventional linkless, drum type ammunition storage system includes an outer, cylindrical tube 12, to which are fixed a plurality of longitudinally extending partitions 14. Adjacent pairs of partitions define a longitudinallly extending channel which receives a column of rounds of ammunition 16 or empty cases 18. Each complete round comprises a case 18 and a projectile 20, and has a center of gravity 22. Each empty case 18 has a center of gravity 24. The system also includes an inner, cylindrical tube 26 to which are fixed the plurality of annular turns or leaves 28 of a longitudinally extending helix 30. Adjacent pairs of leaves define a transversely extending channel which receives an annular layer of rounds or cases. Rotation of the helix progressively advances the columns along their respective channels.

The conventional partition has a longitudinally extending key or rim guide 31 which engages the extractor groove 32 of the case. The extractor groove has a flat aft side surface 34 defining the forward transverse face of the extractor disk 36, and an arcuate forward side surface 38 which merges with the cylindrical base surface 40 of the groove 32. The adjacent surface 42 of the key is rounded to abut and support the surface 38 when the base of the case is down, as in the lower quadrant of the drum. The opposite partition side surface 39 engages the cylindrical edge of the extractor disk 36.

Figure 1:
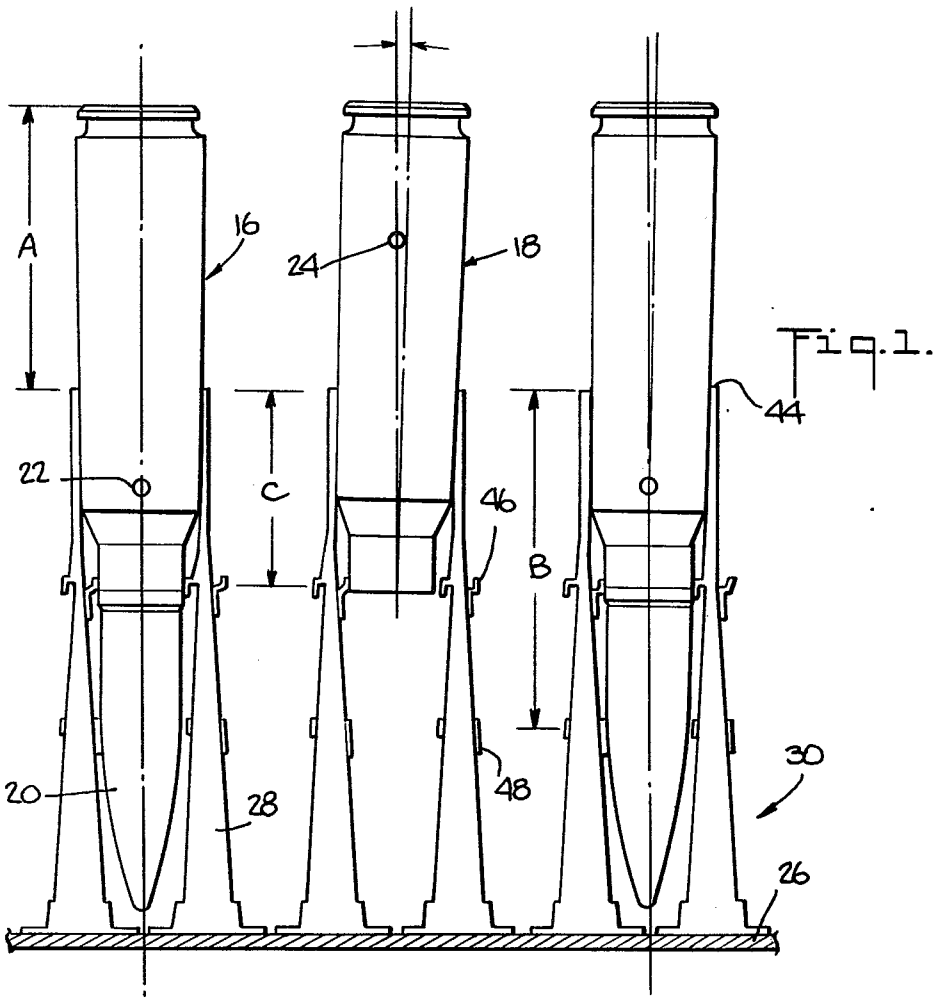
FIG. 1 is a partial view in longitudinal cross-section of a helix of a typical linkless, drum type ammunition storage system.

As seen in FIG. 1, the outer edge 44 of the helix engages each case 18 at a fixed distance A from the extractor disk. With a complete round, the neck of the case engages a ring 46 on the leaf of the helix, and the projectile 20 engages a ring 48 on the leaf, providing a moment arm B, which overlies the center of gravity 22 of the complete round. With an empty round, the neck of the case engages the ring 46, providing a moment arm C which does not overlie the center of gravity 24 of the empty case.

Figure 3:
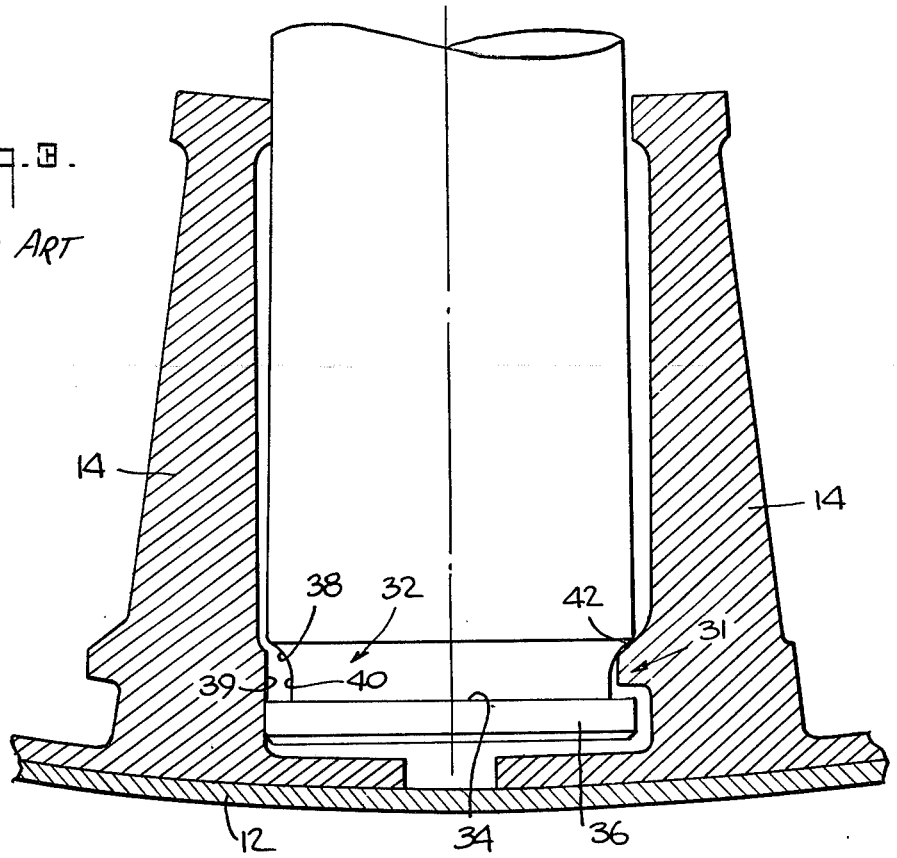
Fig. 3. PRIOR ART
FIG. 3 is a partial view in transverse cross-section of a prior art drum of the system of FIG. 1.

When the case is in the lower quadrant, it tends to wedge between the surfaces 39 and 42 as seen in FIG. 3. This frictional drag provides an overturning moment and a resultant tilt D of the case from being perpendicular to the drum longitudinal axis. The tilt causes more frictional drag which causes more tilt E, deflecting the leaf of the helix, until the case jams.

Figure 4:
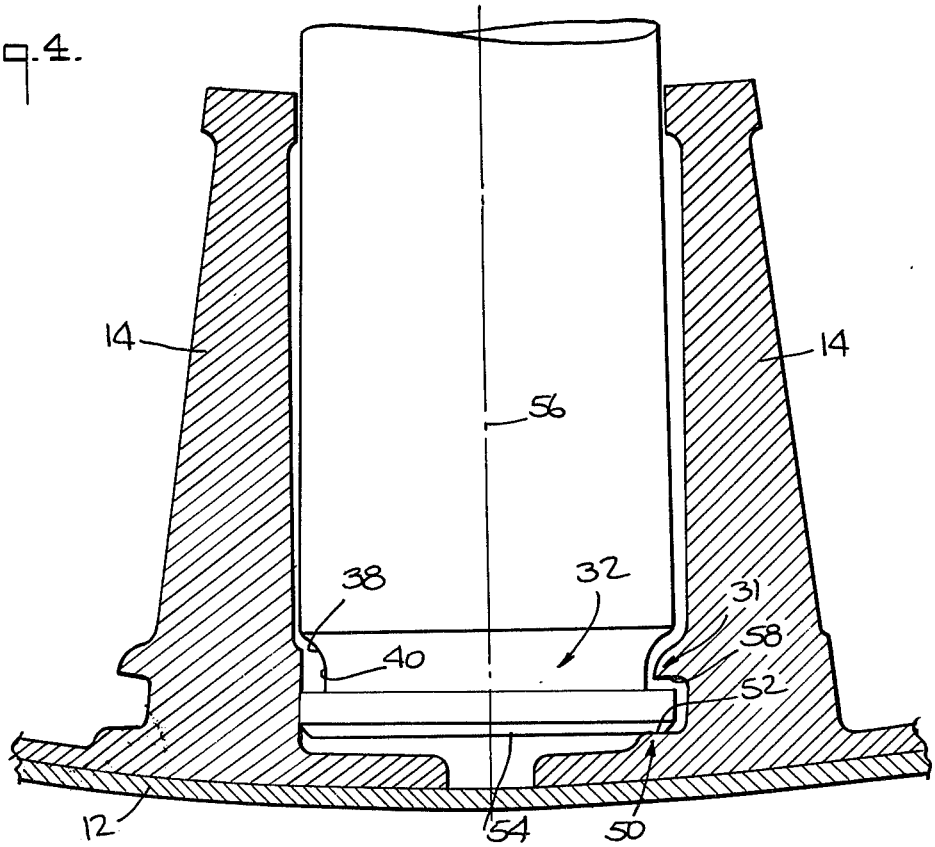
FIG. 4 is a partial view in transverse cross-section of a drum embodying this invention incorporated in the system of FIG. 1.

To preclude such wedging action of cases in the lower quadrant, a stepped rail 50 is provided, as shown in FIG. 4, adjacent to but spaced from the rim guide 31, and offset from the center of the channel. The upper face 52 of the rail abuts the aft transverse face 54 of the extractor disk 36 and spaces the forward face 38 of the extractor groove away from the face 42 of the rim guide. The frictional drag developed between the disk face 54 and the rail face 52, when the case is pushed along the drum longitudinal axis by the rim 44 of the helix, provides a torque which causes the case to rotate about its own longitudinal axis 56. In the upper quadrant, the under face 58 of the rim guide abuts the forward disk face 34 to provide a similar rotational torque. In any other quadrant either the face 52 or the face 58 will be engaged by the extractor disk to provide the rotational torque. In no event are the faces 38 and 42 permitted to abut to develop a wedging action.

While there has been shown and described a preferred embodiment of this invention, it will be appreciated that the invention may be embodied otherwise than as herein specifically illustrated or described, and that certain changes in the form and arrangement of parts and in the specific manner of practicing the invention may be made without departing from the underlying idea or principle of this invention within the scope of the appended claims.

What is claimed:

1. An article handling system, for use in conjunction with a source of gravitational attraction, and with a plurality of substantially cylindrical articles, each article having a longitudinal axis, a transverse end surface perpendicular to the longitudinal axis, and an annular groove adjacent to and spaced from the transverse end surface and providing a transverse annular surface parallel to the transverse end surface, the transverse annular surface and the transverse end surface jointly defining an annular disk, including:

a pair of longitudinally extending, transversely spaced apart side walls, jointly defining a channel having a transverse width which is slightly greater than the diameter of one article, for receiving and freely passing therebetween a longitudinally extending column of side-by-side articles, each article standing on its transverse end surface disposed between said side walls and having a distal portion remote from the transverse end surface and projecting beyond said side walls;

pushing means for pushing the entire column of articles along said channel;

a first, longitudinally extending transverse track surface, facing toward said pushing means and adjacent one of said side walls and spaced from the other of said side walls, and defining the bottom of said channel, for solely abuting and supporting the transverse end surface of each article in said channel when the articles are substantially between said pushing means and the source of gravitational attraction;

a second, longitudinally extending transverse track surface, facing away from said pushing means, and disposed adjacent yet spaced from said first track surface by a distance slightly greater than the thickness of the annular disk of the article, and adjacent one of said side walls and spaced from the other of said side walls, for solely abuting and supporting the transverse annular surface of each article in said channel when said pushing means is substantially between the articles and the source of gravitational attraction;

said pushing means and one of the group comprising said first and second track surfaces jointly interacting with each article, whereby the abutment of said one track surface under the influence of the source of gravitational attraction with one of the group comprising the transverse end surface and the transverse annular surface of each article while such article advances along said channel provides a frictional drag which is eccentric to the longitudinal axis of such article which causes each such article to rotate about its own longitudinal axis.

2. An article handling system according to claim 1 wherein:

said pushing means abuts the cylindrical surface of the distal portion of the aftmost article in the column of articles in said channel.

3. An article handling system according to claim 1 wherein:

said pushing means abuts the cylindrical surface of the distal portion of each article in the column of articles in said channel.

4. An article handling system, for use in conjunction with a source of gravitational attraction, and with a plurality of substantially cylindrical articles, each article having a longitudinal axis, a transverse end surface perpendicular to the longitudinal axis, and an annular groove adjacent to and spaced from the transverse end surface and providing a transverse annular surface parallel to the transverse end surface, the transverse annular surface and the transverse end surface jointly defining an annular disk, including:

a hollow drum of longitudinally extending channels disposed in an annular array about the longitudinal axis of said drum, with the bottoms of said channels remote from said longitudinal axis of said drum, each of said channels comprising a pair of longitudinally extending, transversely spaced apart side walls, jointly defining a channel having a transverse width which is slightly greater than the diameter of one article, for receiving and freely passing therebetween a longitudinally extending column of side-by-side articles, each article standing on its transverse end surface and having a proximal portion including said transverse end surface disposed between said side walls and having a distal portion remote from the transverse end surface and projecting beyond said side walls, each article having its longitudinal axis lying on a radius of said drum;

pushing means disposed in said hollow of said drum for pushing the entire column of articles along said channel;

each of said channels further comprising a first, longitudinally extending transverse track surface, facing toward said pushing means and adjacent one of said side walls and spaced from the other of said side walls, and defining the bottom of said channel, for solely abuting and supporting the transverse end surface of each article in said channel when the articles are substantially between said pushing means and the source of gravitational attraction;

a second, longitudinally extending transverse track surface, facing away from said pushing means, and disposed adjacent yet spaced from said first track surface by a distance slightly greater than the thickness of the annular disk of the article, and adjacent one of said side walls and spaced from the other of said side walls, for solely abuting and supporting the transverse annular surface of each article in said channel when said pushing means is substantially between the articles and the source of gravitational attraction;

said pushing means and one of the group comprising said first and second track surfaces jointly interacting with each article, whereby the abutment of said one track surface under the influence of the source of gravitational attraction with one of the group comprising the transverse end surface and the transverse annular surface of each article while such article advances along said channel provides a frictional drag which is eccentric to the longitudinal axis of such article which causes each such article to rotate about its own longitudinal axis.

5. An article handling system according to claim 4 wherein:

said pushing means abuts the cylindrical surface of the distal portion of the aftmost article in the column of articles in each of said channels.

6. An article handling system according to claim 4 wherein:

said pushing means abuts the cylindrical surface of the distal portion of each article in the column of articles in each of said chamber.

7. An article handling system according to claim 6 wherein:

each of the articles is a round of ammunition having a cartridge case, the transverse surface is the base of the case, and the annular groove is the extractor groove.

8. An article handling system according to claim 7 wherein:

said pushing means is multileafed helix, each leaf abuting one case projecting from each column respectively.

9. An article handling system according to claim 1 wherein:

said first and second track surfaces are adjacent the same one of said side walls and are mutually parallel.

10. An article handling system according to claim 4 wherein:

said first and second track surfaces are adjacent the same one of said side walls and are mutually parallel.

* * * * *